United States Patent [19]

Aschoff et al.

[11] 4,418,342

[45] Nov. 29, 1983

[54] METHOD OF AND A CIRCUIT FOR INDICATING THE OPTIMUM ADJUSTMENT OF THE WORKING POSITION OF A BRUSH ROLLER IN AN ELECTRICALLY OPERATED FLOOR CLEANING APPLIANCE

[75] Inventors: Hans-Joachim Aschoff, Wuppertal; Lothar Cholewa, Herne, both of Fed. Rep. of Germany

[73] Assignee: Vorwerk & Co Interholding GmbH, Wuppertal, Fed. Rep. of Germany

[21] Appl. No.: 306,701

[22] Filed: Sep. 29, 1981

Related U.S. Application Data

[63] Continuation-in-part of Ser. No. 46,373, Jun. 7, 1979, abandoned.

[30] Foreign Application Priority Data

Jun. 15, 1978 [DE] Fed. Rep. of Germany ..... 2826133

[51] Int. Cl.[3] ..... G08B 21/00

[52] U.S. Cl. ..... 340/679; 15/49 C; 15/339; 340/540; 340/691

[58] Field of Search ..... 340/679, 664, 662, 661, 340/540, 691; 310/68 C; 15/319, 339, 49 C, 53 A

[56] References Cited

U.S. PATENT DOCUMENTS

| | | | |
|---|---|---|---|
| 3,011,188 | 12/1961 | Menche | 15/49 C |
| 3,662,418 | 5/1972 | Kamiya | 15/53 A |
| 3,809,985 | 5/1974 | Krause et al. | 340/664 |

*Primary Examiner*—Glen R. Swann, III

*Attorney, Agent, or Firm*—Michael J. Striker

[57] ABSTRACT

The method of and the device for indicating the optimum adjustment of the effective length of bristles of a bristle roller in a floor cleaning appliance driven by an electric motor is based on the measurement of a voltage drop across a resistor connected in series with the electromotor; the voltage drop is applied to a switching circuit including two parallel branches of series connected switching diodes with light-emitting diodes so as to activate the light-emitting diodes when the voltage drop exceeds the bias determined by the threshold voltages of the switching diodes.

7 Claims, 4 Drawing Figures

METHOD OF AND A CIRCUIT FOR INDICATING THE OPTIMUM ADJUSTMENT OF THE WORKING POSITION OF A BRUSH ROLLER IN AN ELECTRICALLY OPERATED FLOOR CLEANING APPLIANCE

CROSS-REFERENCE TO A RELATED APPLICATION

This is a continuation-in-part of application Ser. No. 046,373 filed June 7, 1979, now abandoned.

BACKGROUND OF THE INVENTION

The present invention relates generally to floor cleaning appliances driven by an electric motor, and more particularly it relates to a method of and a device for the indication of the optimum adjustment of the length of bristles of a brush or bristle roller projecting from the housing of the floor cleaning appliance, particularly of a carpet cleaner.

In conventional floor cleaning appliances having a bristle roller driven by an electric motor, such as in the case of electrically operated carpet brushes, it is not possible to adjust the length of bristles projecting from the housing so as to meet exactly the requirements for the optimum operation of the appliance. The adjustable length of the bristles projecting from the housing determines the degree of engagment of the brush or bristle roller with the floor or carpet to be cleaned. An exact adjustment of the right length of the projection of the bristle roller from the housing is, therefore, particularly important inasmuch as in the case of insufficient length the cleaning effect considerably decreases or almost disappears and in the case of an excessive length of the projecting bristles the torque in the driving electromotor unduly increases so that the motor together with its transmission element (such as a transmission belt) are excessively loaded. In addition, if the brush roller is adjusted to a position where its bristles project too far from the appliance housing, there is the danger that the fabric of the carpet being cleaned may become damaged.

SUMMARY OF THE INVENTION

It is, therefore, a general object of the present invention to overcome the aforementioned disadvantages.

More particularly, it is an object of this invention to provide an improved electrical floor cleaning appliance such as, for example an electric carpet cleaner, which enables the user to adjust more readily the effective operational length of the bristles of the brush roller.

Another object of this invention is to facilitate the optimum adjustment of the working position of the bristle roller by automatically indicating the variation from this optimum working position.

An additional object of the invention is to provide such an improved cleaning appliance where the indication of the optimum working adjustment of the bristle rollers is achieved with minimum technological expenses and in a simple manner.

In keeping with these objects, and others which will become apparent hereafter, one feature of the invention resides in a floor cleaning appliance having an electric motor for driving an adjustable bristle roller, in the provision of a resistance connected in the current circuit of the driving motor. A threshold value switching circuit is coupled to the resistance to respond to predetermined voltage variations across the latter, and an optical indicator is connected to the switching circuit to generate an optical signal when a prescribed voltage corresponding to a particular torque of the driving motor and thus to a certain load of the bristle roller, has been attained.

In the preferred embodiment of this invention, the threshold value switching circuit is assembled of semiconductors defining characteristic threshold voltages for their operation and these threshold voltages are utilized for the switching action.

By connecting the aforementioned semi-conductors in series, there results a possibility to preset different switching points corresponding to desired switching voltages.

The method of this invention is based on comparing an electrical value derived from the current flowing through the motor and corresponding to the load applied against the roller during its cleaning operation, with at least one preset electrical value representing a selected load for the roller and converting the difference between the actual value of the load and the preset threshold value into a warning signal.

In the preferred embodiment of the circuit for realizing the method of this invention, the threshold value switching circuit is coupled to a register connected in series with the current circuit of the driving motor. The threshold value switching circuit includes two or more parallel connected combinations or subcircuits of series connected light-emitting diodes acting as indicating means with normal diodes and/or with Zener diodes acting as the threshold switching elements.

In a modification of the preferred circuit of this invention, the threshold value switching circuit is constituted of a combination of series connected diodes or Zener diodes with a light-emitting diode and of an additional circuit connected parallel to a stator winding of the electric motor, this additional circuit including a rectifier, an amplifying transistor supplied with the voltage from the rectified and a light-emitting diode connected parallel to the output of the transistor, whereby the base electrode of the transistor is coupled to the resistor, in the current circuit of the electric motor.

The light-emitting diodes thus indicate optically the working condition of the bristle rollers in the cleaning appliance and enable the adjustment of the correct effective length of the bristles projecting from the appliance housing.

The optical indication according to the invention can be achieved with simple electronic structural components without the use of a separate power supply.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
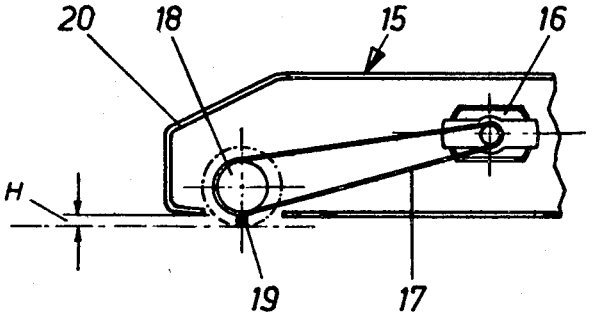
FIG. 1 is a sectional side view of a portion of an electric carpet brush.

Referring firstly to FIG. 1, there is shown the principle of a conventional electric carpet brush 15 which includes a housing 20 supporting for rotation a brush or bristle roller 18 having on its periphery clusters of bristles 19. The effective length H of the bristles 19 projecting from the housing 20 determines the cleaning effect of the appliance. It has been found experimentally that only a quite specific length H of the projecting portion of the bristles 19 results in the optimum cleaning action. The adjustment of this specific length H can now be made by means of indicators as illustrated by way of example in FIGS. 2 and 3.

Figure 2:
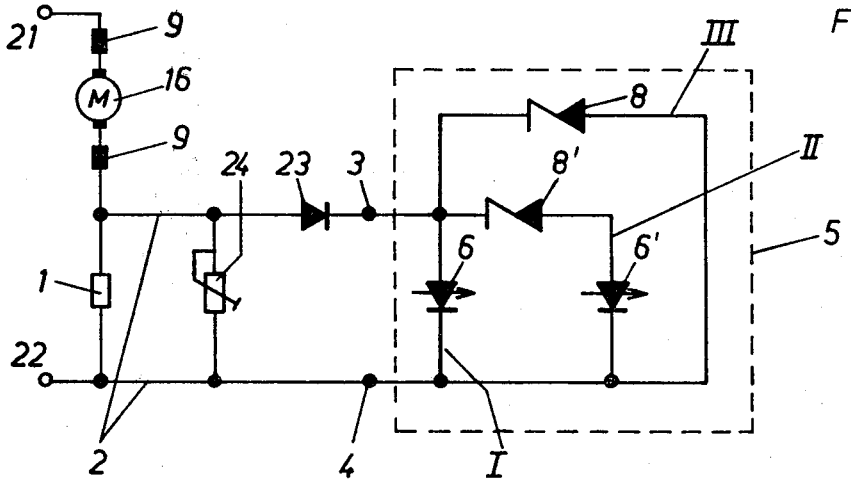
FIG. 2 is a circuit diagram of a device for indicating the optimum adjustment of the effective length of the bristles in the brush roller of FIG. 1.

FIG. 2 illustrates a circuit diagram including semiconductive diodes only. The driving motor 16 includes two stator windings 9 which are connected to power supply terminals 21 and 22 through a series connected resistor 1. Accordingly, the current flowing through the stator windings 9 of the motor 16 generates a voltage drop across the resistor 1 and this voltage drop is indicative of the torque resulting in the electromotor due to the load of the bristle roller 19. Parallel to the resistor 1 is connected a variable resistor 24 by means of which the voltage drop is adjusted. A rectifying diode 23 rectifies the voltage and conduits 2 apply the rectified voltage to points 3 and 4 at the input of a threshold value switching circuit 5. In this embodiment, the switching circuit 5 includes three parallel connected circuit branches, namely branch I consisting of a light-emitting diode 6, branch II including a series connection of a Zener diode 8' and a light-emitting diode 6', and a circuit branch III including a Zener diode 8.

The operation of the circuit according to this embodiment is as follows:

If the length H of the bristles projecting from the housing 20 is adjusted too short, the driving electric motor 16 rotates almost without load. As a result, the torque of the motor is also very small and so is the electrical current flowing through the series connection of windings 9 and resistor 1. The small voltage drop which occurs across the resistor 1 is adjusted by the variable resistor 24 to such a value that the rectified voltage is below the biasing voltage of the light-emitting diode 6 in the circuit branch I and, consequently, both light-emitting diodes 6 and 6' are switched off. If, however, the length H of the bristles projecting from the housing 20 is adjusted to a value at which the operation of the cleaning appliance is optimum, the torque transmitted to the driving electric motor increases and so increases the voltage drop across the resistor 1. The biasing threshold of the light-emitting diode in branch I is now tresspassed and the diode 6 starts to shine. The light-emitting diode 6' in the circuit branch II is still switched off since it is connected in series with a Zener diode 8' and its threshold bias voltage has not been yet exceeded. If the effective length H of the projecting bristles 19 has been adjusted too large, the torque of the motor 16 exceeds the optimum value and so does the motor current, and the voltage drop across resistor 1 attains a value which exceeds the breakdown voltage of Zener diode 8' and switches on the light-emitting diode 6' in the branch II.

The Zener diode 8 in the branch III has a breakdown voltage which is higher than that of the Zener diode 8' in the branch II and protects thus the branches I and II against overload. The light-emitting diode 6 in branch I can be selected to emit a green light for example, and the light-emitting diode 6' in branch II shines red. In this manner, the user receives the following signals:

If the length H of the bristles is selected too small, both diodes 6 and 6' do not emit any light. During the optimum adjustment of the length H, a green light is emitted from the diode 6 and if the length H is too large, then both the green and the red light-emitting diodes 6 and 6' are shining.

Figure 3:
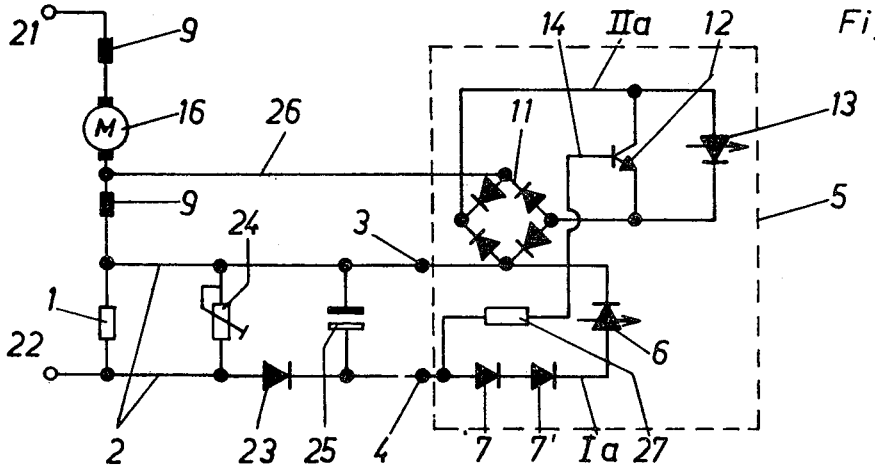
FIG. 3 is a modification of the circuit of FIG. 2.

Still more convenient indication of the working condition of the bristle roller is attained by the circuit as shown schematically in FIG. 3. Similarly, as in the circuit of FIG. 2, a series resistor 1 is arranged in the feeding current circuit of the stator windings 9 of the electric motor 16 and the voltage drop occurring across the resistor 1 is applied via conduits 2 and a rectifying diode 23 to the input points 3 and 4 of a threshold value switching circuit 5. The voltage drop is adjustable by means of a variable resistor 24 and the rectified voltage is stored in a capacitor 25 connected across the points 3 and 4. In this embodiment, the switching circuit 5 is constituted of two circuit branches only, namely of branches Ia and IIa.

The circuit branch Ia includes a series connection of two normal semiconductive diodes 7 and 7' and of a light-emitting diode 6. The circuit branch IIa is connected parallel to the input points 3 and 4 and includes a rectifying bridge 11 the input of which is connected by means of conduit 26 parallel to one stator winding 9 of the electromotor 16. The output of the bridge rectifier 11 is applied across the collector-emitter circuit of a transistor 12 and across a light-emitting diode 13 connected in parallel to the latter. The base electrode 14 of transistor 12 is connected via a current limiting resistor 27 to the input point 4.

The operation of the circuit of FIG. 3 is as follows:

If the effective length H of cleaning bristles 19 is too small, electromotor 16 rotates almost without load and only a minimum current flows therethrough. Accordingly, only a small voltage drop occurs across the resistor 1 and is adjusted by the variable resistor 24 to a value which is below the bias voltage of the light-emitting diode 6 resulting in the series connection with the normal diodes 7 and 7' in the branch Ia, and the diode 6 remains dark. The number of series connected normal diodes 7 and 7' can be selected according to a bias or threshold switching point of the light-emitting diode 6 for initiating the actuation of the diode within a desired range of the adjustable voltage drop. Nonetheless, the voltage across the stator winding 9 is sufficiently high as to supply via the bridge rectifier 11 the light-emitting diode 13 with a biasing voltage sufficient to emit light while the transistor 12 is switched off. When the position of bristle roller 18 has been adjusted for optimum effective length H of the projecting bristles 19, voltage drop across resistor 1 as explained above in the example of FIG. 2, also increases to a value which is still insufficient to turn on the light-emitting diode 6 in the branch circuit Ia but which is sufficient to turn on via the resistor 27, the switching transistor 12 which becomes conductive and short-circuits the light-emitting diode 13. Accordingly, during the optimum adjustment of the bristle roller 18, none of the light-emitting diodes 6 and 13 is shining. If the effective length H is too large, the voltage drop across the resistor 1 still further increases the value which exceeds the bias of the normal diodes 7 and 7' in branch Ia and the threshold voltage of the light-emitting diode 6 is exceeded and the latter switches on and starts to shine.

The user of the appliance provided with the signalling system according to FIG. 3 receives indicating signals which deviate from the pattern of signals in the circuit of FIG. 2 as follows:

If the length H of bristles is adjusted below the optimum operation of the appliance, the diode 13 in circuit branch IIa emits light and the optical signal could be designated by the inscription "too small," for example.

During the optimum adjustment of the working length of the bristles of the roller 18, none of the two diodes 6 and 13 emits light.

If the length H of the bristles is excessively large, the other diode 6 in circuit branch Ia is emitting light and this warning signal could be designated by an inscription "too large" or the like. This circuit arrangement provides, therefore, a simpler indication of the operating conditions of the brush rollers.

Figure 4:
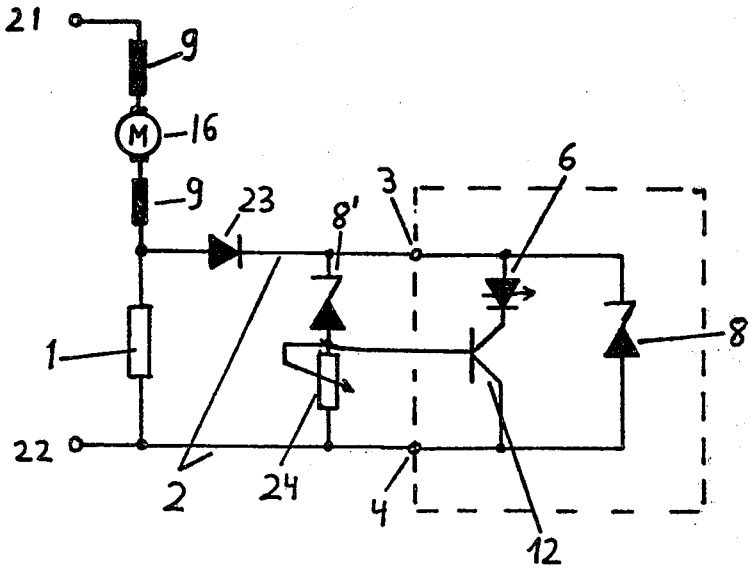
FIG. 4 is another modification of the circuit of FIG. 2.

Still another modification of the circuit of this invention is illustrated in FIG. 4. The voltage drop or the measuring voltage across resistor 1 is again proportional to the torque of electric motor 16 and to the current in stator windings 9. Positive half waves of this measuring voltage are passed through diode 23 and applied to inputs 3 and 4 of a voltage sensitive indicating circuit, illustrated in a dashed-line box. This combined switching and indicating circuit includes a switching transistor 12 and a light-emitting diode 6, the connection bridging the inputs 3 and 4 so that both the transistor 12 and the light-emitting diode 6 are energized by the rectified measuring voltage. The switching voltage for transistor 12 is supplied by a voltage divider constituted by a series connection of a Zener diode 8' and an adjustable resistor 24 connected to the base of the transistor 12. As a result, transistor 12 switches on the light-emitting diode only then when voltage across the adjustable resistor 24 exceeds a specified trigger value. This switching voltage is again determined by an optimum load of motor 16 which in turn depends on an optimum length H of the adjusted bristles 19. Due to the Zener diode 8, however, the switching voltage is effective only upon exceeding a predetermined breakdown voltage of the Zener diode. In this manner, a sharply delimited switching range of the light-emitting diode 6 is achieved. Since the breakdown voltage of the Zener diode 8' is larger than the switch-on voltage of the light-emitting diode 6, there is always sufficient power supply voltage available for the light-emitting diodes. The other Zener diode 8 connected across the elements 6 and 12 serves merely for delimiting the maximum voltage drop across this series connection.

It will be understood that each of the elements described above, or two or more together, may also find a useful application in other types of circuits differing from the types described above.

While the invention has been illustrated and described as embodied in a signal circuit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A circuit for indicating the optimum adjustment of the working position of a bristle roller driven by an electric motor in a floor cleaning appliance, comprising a resistance connected in series with the current circuit of the electric motor; a switching circuit responsive to a predetermined voltage drop across said resistance; indicating means controlled by said switching circuit for signalling a difference between said voltage drop and a preset voltage corresponding to the load of said motor at the optimum adjustment of said roller; and said switching circuit including at least two parallel connected circuit branches, one of said branches including a light-emitting diode and the other branch a series connection of a semiconductive switching element and a light-emitting diode.

2. The circuit as defined in claim 1, wherein said switching element is a Zener diode.

3. The circuit as defined in claim 1, wherein said series connected switching diode in at least one circuit branch determines the magnitude of the biasing voltage for the light-emitting diode in said branch.

4. A circuit for indicating the optimum adjustment of the working position of a bristle roller driven by an electric motor in a floor cleaning appliance, comprising a resistance connected in series with the current circuit of the electric motor; a switching circuit responsive to a predetermined voltage drop and being connected across said resistance; and electric indicating means having a power source connected in series with the current circuit of the electric motor and being controlled by said switching circuit for signalling a difference between said voltage drop and a preset voltage corresponding to the load of said motor at the optimum adjustment of said roller.

5. The circuit as defined in claim 4, wherein said switching circuit includes a first circuit branch formed by a series connection of at least one diode and a light-emitting diode, said first branch being connected parallel to said resistance; a second circuit branch including a rectifying bridge having an inlet connected across the winding of said electric motor, a light-emitting diode connected to the output of said rectifying bridge, a switching transistor having its collector-emitter circuit connected parallel to said light-emitting diode and its base connected to said series connection of said diodes in said first branch.

6. A circuit for indicating optimum adjustment of the working position of a bristle roller driven by an electric motor in a floor cleaning appliance, comprising a resistance connected in series with the current circuit of the electric motor; a combined switching and indicating circuit including a series connection of a switching transistor and a light-emitting diode; a source of trigger voltage for the switching transistor; a rectifier connected to the resistance for energizing the combined circuit and the source; and the source including a series connection of a Zener diode and a resistance having their common point connected to the base of the switching transistor.

7. A method of indicating the optimum adjustment of the working position of a bristle roller driven by an electric motor in a floor cleaning appliance, comprising the steps of deriving an actual electrical value proportional to the current flowing through the motor; comparing the actual electrical value with at least one preset value representing a load condition of the roller at a particular adjustment of the effective length of its bristles to determine a difference value; applying the difference value to a switching and indicating device energized by the motor current and having different threshold switching points to generate a signal indicating a difference between an optimum working position and the actual working position of the bristle roller; said actual electrical value being a voltage drop across a resistor and said switching and indicating device being a semiconductive light-emitting element controlled by said voltage drop and having a breakdown voltage level; said switching and indicating device including a parallel connection of a plurality of semiconductive switching and light-emitting elements having different threshold voltage levels for being successively controlled by voltage drop variations to switch at different levels of said voltage drop; and said parallel connection including at least one series connected branch of a switching diode and a light-emitting diode.

* * * * *